US011547202B2

(12) United States Patent
Kamm

(10) Patent No.: US 11,547,202 B2
(45) **Date of Patent: *Jan. 10, 2023**

(54) WIRE-CORE APPLICATOR HAVING MULTI-MATERIAL BRISTLES

(71) Applicant: GEKA GmbH, Bechhofen (DE)

(72) Inventor: Wolfgang Kamm, Dietenhofen (DE)

(73) Assignee: GEKA GmbH, Bechhofen (DE)

( * ) Notice: Subject to any disclaimer, the term of this patent is extended or adjusted under 35 U.S.C. 154(b) by 248 days.

This patent is subject to a terminal disclaimer.

(21) Appl. No.: 16/802,997

(22) Filed: Feb. 27, 2020

(65) Prior Publication Data

US 2020/0196743 A1 Jun. 25, 2020

Related U.S. Application Data

(63) Continuation of application No. 15/500,876, filed as application No. PCT/EP2015/067703 on Jul. 31, 2015, now Pat. No. 10,610,007.

(30) Foreign Application Priority Data

Jul. 31, 2014 (DE) ..... 202014103564.8
Jul. 31, 2014 (DE) ..... 202014103565.6
Jul. 31, 2014 (DE) ..... 202014103567.2

(51) Int. Cl.
*A46B 9/02* (2006.01)
*A46B 3/18* (2006.01)
*A46D 1/00* (2006.01)

(52) U.S. Cl.
CPC ..... *A46B 9/021* (2013.01); *A46B 3/18* (2013.01); *A46D 1/023* (2013.01); *A46D 1/0207* (2013.01);

(Continued)

(58) Field of Classification Search
CPC ... A46B 9/021; A46B 3/18; A46B 2200/1053; A46D 1/0207; A46D 1/023; A46D 1/0246; A46D 1/0261; A46D 1/0276
See application file for complete search history.

(56) References Cited

U.S. PATENT DOCUMENTS 4,733,425 A 3/1988 Hartel et al.
4,964,429 A 10/1990 Cole
(Continued)

FOREIGN PATENT DOCUMENTS

DE 29700611 U1 3/1997
DE 10130863 A1 2/2003
(Continued)

*Primary Examiner* — Randall E Chin

(57) ABSTRACT

A mascara brush having a centre made of at least two wire sections twisted together along a longitudinal axis of the wire core, and having a bristle covering made of plastic bristles formed by filaments, each of which bristles is held in a clamping manner between the two wire sections, and which bristles are formed with a wedge-shaped bristle tip or without a wedge-shaped bristle tip on their free ends. At least one portion of the bristles has a bristle coating made of a first softer material, and a bristle core that is joined to the bristle coating and made of a second harder material, and at least these bristles have a transverse cut, in the form of a simple wedge, on one side or on two sides, at least partially on their radially outward free ends, and comprise a wedge-shaped bristle tip having at least one cut surface forming a wedge.

20 Claims, 5 Drawing Sheets

(52) U.S. Cl.
CPC ..... *A46D 1/0238* (2013.01); *A46D 1/0246* (2013.01); *A46D 1/0261* (2013.01); *A46D 1/0276* (2013.01); *A46B 2200/1053* (2013.01)

(56) References Cited

U.S. PATENT DOCUMENTS

| | | | | |
|---|---|---|---|---|
| 5,161,554 | A | 11/1992 | Fitjer | |
| 5,161,555 | A | 11/1992 | Cansler et al. | |
| 6,311,359 | B1 | 11/2001 | Brezler, III | |
| 6,391,445 | B1 | 5/2002 | Weihrauch | |
| 6,669,389 | B2 | 12/2003 | Gueret | |
| 6,962,160 | B2 | 11/2005 | Dumler | |
| 8,568,049 | B2 * | 10/2013 | Kulik | A46D 1/0292 401/129 |
| 2004/0011375 | A1 | 1/2004 | Dumler | |
| 2004/0112400 | A1 | 6/2004 | Kurek | |
| 2005/0034740 | A1 | 2/2005 | Eckers et al. | |
| 2012/0211019 | A1 | 8/2012 | Ruber | |
| 2012/0233791 | A1 * | 9/2012 | Uchida | A46D 1/0207 15/167.1 |
| 2012/0305022 | A1 | 12/2012 | Bickford | |

FOREIGN PATENT DOCUMENTS

| | | | |
|---|---|---|---|
| DE | 10232589 | A1 | 1/2004 |
| DE | 202013009431 | U1 | 3/2015 |
| EP | 1264562 | A1 | 12/2002 |
| EP | 2710921 | A2 | 3/2014 |
| JP | 2008307304 | A | 12/2008 |

* cited by examiner

WIRE-CORE APPLICATOR HAVING MULTI-MATERIAL BRISTLES

FIELD OF THE INVENTION

The invention is directed to a mascara brush with an inner core of at least two wire portions twisted together and a bristle covering of bristles formed by filaments that are each held clamped between the two wire portions, the bristles carrying a wedge-shaped pointed portion (3) at their free ends.

BACKGROUND OF THE INVENTION

Applicators of this type are also referred to as wire core applicators.

These applicators are still greatly appreciated today, because not only do they afford advantages with regard to their application, but also have various advantages in production that cannot be achieved with the injected applicators that compete with them. For example, small series can also be manufactured rather effectively because as a rule, very different wire core applicators can be produced on the existing production systems without considerable sums having to be invested in new tools for the one special applicator, unlike for injected applicators.

In general, it also applies to wire core applicators that they are supposed to meet two requirements, in particular:

Their bristle covering is supposed to have as great a mass storage capacity as possible so that the applicator needs to be dipped into the cosmetics supply only once or only a few times in order to envelop the eyelashes with a sufficiently voluminous layer of mascara mass.

On the other hand, their bristle covering is supposed to have as good a separation capacity as possible, i.e. the capacity of separating obliquely overlying eyelashes of the curve of the eyelashes and aligning them in a largely parallel manner. The reason for this is not least that the eyelashes can only be provided with the desired volume by means of the mascara mass if they are each coated all around individually, and not already previously drenched and stuck together in clumps with mascara mass.

In general, it thus applies to wire core applicators that they are supposed to meet high requirements, in particular, for the mass storage capacity with regard to the substance that is to be applied with them.

Various solutions have already been proposed in the prior art to take account for this.

For example, U.S. Pat. No. 4,733,425 proposes the use of bristles that are internally hollow or have a star-shaped, non-circular cross section. Such bristles have an excellent mass storage capacity but do not contribute to any significant improvement of the separation capacity of the applicator. In particular, this is due to the fact that these bristle cross sections result in bristles that, compared with cylindrical bristles made from solid material, are significantly more susceptible to buckling and therefore have a poorer capacity of penetrating between overlying eyelashes of the curve of the eyelashes. Because as soon as bristles of this type impact one or more eyelashes with their end faces, they tend to buckle instead of forcefully pushing the eyelashes aside and thus separating them.

In contrast, U.S. Pat. No. 5,161,555 proposes the use of heavily waved filaments in order to produce an improved wire core applicator. It is thus possible to obtain a very uniform bristle covering, just as according to the teaching of U.S. Pat. No. 5,161,554, which proposes the use of filaments with great diameter variations, i.e. filaments that, locally, have a very small diameter and, directly thereafter, in the immediate vicinity, a considerably larger diameter. Both of the latter patents, however, are unable to contribute substantially to the improvement of the separation capacity.

Only in passing, it may be noted that an applicator with injection-molded bristles is known from the U.S. Pat. No. 4,964,429, which is characterized in that the bristles are configured in a clearly conically shaped manner and are arranged with a not inconsiderable, defined distance from each other. Such bristles do indeed exhibit a good separation capacity. However, the bristle configuration recommended by this patent can only be realized in injection-molded applicators, not in wire core applicators. Therefore, this patent is also incapable of contributing to the improvement of wire core applicators.

In practice, wire core applicator with bristles whose tips are ground, so that they taper significantly, have already become known.

The use of such bristles results in a substantial improvement of the separation capacity in wire core applicators.

However, there is still a further need for optimization, particularly if the wire core applicator has a particularly dense bristle covering. In that case, it is basically clear that the separation capacity of such bristles can be increased further by producing the bristles from as hard a material as possible, which provides the bristle with a higher rigidity or buckling strength with the same diameter, and thus causes two positive effects:

A rigid bristle is inherently better capable of penetrating between overlying eyelashes of the curve of the eyelashes.

In addition, a rigid bristle has a much smaller tendency to evade the grinding disk, and therefore offers the possibility of a more pronounced grinding of the tips than a softer bristle.

However, the attempt to use hard materials and, in particular, hard plastic materials reveals the problem that the quality of the outer edge of the ground surface declines during grinding, i.e. that the edge no longer forms a clean continuous line, but often exhibits a ragged contour. This impedes the sliding of the eyelash along the edge and is therefore disadvantageous.

In view of this, it is the object of the invention to provide a wire core applicator covered with bristles that have a further improved separation capacity.

SUMMARY OF THE INVENTION

This brush is characterized in that the filaments that form the bristles in it are pointed in a wedge shape at their free ends and are thus better able to separate the eyelash covering and to separate, i.e. push to the side, the individual eyelashes.

In this case, the special feature according to the invention is that the respective filament, or the bristles formed by the filament, do not uniformly consist of one and the same harder or softer material, but that the filament has a jacket of a softer material and a core of an, in comparison therewith, harder material.

Since bristles that are as hard as possible and, at the same time, slender are advantageous for separating the eyelashes as efficiently as possible, it would as such have been obvious to produce the jacket of the filament or the jacket of the bristles from the harder material, and not the core. This reason for this is that the radially outward areas of a cylinder are known to contribute much more to the bending rigidity than the central or core area of a cylinder located close to the neutral fiber.

However, the invention shows that the core also provides the filament or the bristles formed by the filament with a greater bending rigidity, even when the bristle ends are ground to a generous extent and in the process lose the predominant part of their original jacket in the ground area. The hard core, which is preserved to a good extent even during grinding, simplifies making the free bristle ends pointed in as flat a manner as possible by grinding them, for it prevents the bristles from being able to evade the grinding disk all too easily, thus coming into contact with the grinding disk with insufficient intensity, so that they are efficiently ground and, above all, ground over a considerable length. Thus, the invention makes it much easier to provide the respective bristle end with as flat a wedge angle as possible and at least with as long a wedge surface as possible.

On the other hand, the behavior of the soft jacket supported by the hard core is exceptionally non-problematic during grinding, and it surprisingly forms a well-defined outer edge, free from fraying and/or chipping, i.e. irregularities that the individual eyelashes can hook into when the pointed bristle end penetrates the eyelash cover, which could affect the separation result adversely.

According to the invention, it is sufficient if the predominant part of the filaments consists of the claimed material mix; for example, a certain number of filaments, e.g. thinner filaments, which frequently forms a minority and which consists of only a single material in each case, may be among the filaments that, for example, form the covering. These are preferably filaments that are consistently made from the softer material also used for the ground filaments.

Nevertheless, it was found to be particularly advantageous if at least 75% of all filaments, and ideally even all of the filaments used for a mascara applicator, are made from the claimed material mix.

It is particularly beneficial if the first and preferably also the second material is a plastic, ideally a thermoplastic plastic.

Within the context of a preferred embodiment, it is provided that the two plastics are firmly bonded to each other by co-extrusion, and the filaments are sections of one or more continuously co-extruded threads. In this case, co-extrusion is not simply an arbitrary, exchangeable method, but embosses the continuous thread, and thus also the filaments cut from it, with its particular microstructure. On the one hand, this microstructure is characterized in that the two different plastic materials are glued or welded to each other particularly intimately and, on the other hand, that their plastic molecule chains have a significant orientation in the direction of the longitudinal axis, which later forms the longitudinal bristle axis.

It was found to be particularly beneficial if the wedge-shaped pointed portion consists of two chisel faces that extend obliquely to the longitudinal filament axis, are inclined relative to one another and intersect at the distal end, or even beyond the distal end, of the filament, i.e. forms a "roof-shaped structure" that either forms a cutting edge at an end face or, in any case, has only a very small end face. A bristle configured in this manner is able to push eyelashes away to both sides and thus separate them. Unlike a bristle that is simply obliquely cut, such a bristle does not exhibit an irritating preferred direction.

It is particularly beneficial if the chisel faces are substantially planar in themselves. Ideally, two opposite chisel faces at the same bristle end substantially have the same size.

Ideally, the surface roughness of the chisel faces is greater than the surface roughness of the non-beveled shaft region of the filament. This benefits the desired sliding of the individual eyelashes along the respective bristle shafts, and thus the separation.

It is particularly beneficial if the surface roughness Rz of the surface or surfaces that form the pointed portion and extend obliquely to the longitudinal axis L is ≤6.3 μm, and is preferably in the range between 0.2 μm and 6.3 μm, the above-mentioned limit values included in each case.

The surface roughness Rz, which is also referred to as roughness depth, is to be determined in accordance with DIN EN ISO 4287/4288.

A second material is to be preferred which has a modulus of elasticity (E modulus) of at least ≥1300 N/mm$^2$. It is significantly better if the second material has an E modulus of at least ≥1700 N/mm$^2$. For most cases of application, it is advisable if the E modulus of the second material does not exceed 2700 N/mm$^2$.

It may be beneficial to incorporate polyamide 6.12 into the bristle core.

It is provided within the context of a preferred embodiment that the first material has a Shore D hardness≤80. The method for measuring the Shore hardness D is standardized; the relevant standards are the standards DIN EN ISO 868 and DIN ISO 7619-1.

In a filament or bristle coextruded from two different plastics having the above characteristic parameters, there is also the advantage that the grinding of the cut faces with one and the same grinding disk results in different roughnesses in the above-mentioned roughness depth range at the jacket and the core components of the coextruded bristles, due to the different E modules, with these different roughness depths, however, furthermore fulfilling the two most important functions of a bristle, i.e. the separation and combing of the eyelashes and the simultaneous wetting of the eyelashes during an application movement.

It is provided within the context of a preferred embodiment that the diameter of the filaments is ≥115 pr. It has proved to be particularly beneficial if the filaments according to the invention have a diameter in the range between 300 μm and 500 μm.

Within the context of a development of the invention, it is provided that the wall thickness of the jacket measured in the radial direction is in the range between 15 μm and 100 μm.

By forming a wedge-shaped cut face, which improves combing, with a roughness Rz between 0.2 μm and 6.3 μm, in particular between 2.9 μm and 6.3 μm, the mascara accommodating capacity of each bristle cut in a wedge-shaped oblique manner is improved. In this case, it is particularly advantageous that, due to the roughness according to the invention, the obliquely extending cut faces have a good mascara accommodating capacity and, thus, also a correspondingly good mascara discharging capacity to the eyelash hairs that first slide along them during the combing process. Thus, the cut faces are of particular importance since, during the make-up process, the eyelashes are first guided along this surface and slide along it at the beginning of the make-up movement.

The surface roughness (Rz) is produced by grinding the bristle ends by means of a grinding disk. In particular, the desired roughness of the oblique cut face can be influenced and determined by selecting the roughness of the grinding disk(s) used during grinding accordingly.

The special characteristic of the brush according to the invention is that its bristle covering has bristles that carry at their free ends a wedge-shaped tip instead of an end face extending substantially perpendicularly to the longitudinal bristle axis.

It is therefore useful if the total number of bristles has, for the predominant part, a wedge-shaped tip with at least one cut face. Advantageously, a part of the bristles then has a wedge-shaped tip, which is formed by an oblique cut, with a cut face.

As will be explained in greater detail later, the at least one wedge surface with which a bristle can be equipped according to the invention makes it possible to push the bristle between the eyelashes in such a manner, at the beginning of the application, that the respective eyelash better remains in contact with the bristle, even after the eyelash has slipped from the cut face forming the wedge surface into the area of the bristle shaft. Thus, the respective bristle shaft and the cut faces are able to discharge more of the mascara mass to the eyelash. Thus, a better coating of the eyelash takes place. Not least, the eyelash volume to be achieved benefits from this.

Preferably, the wedge-shaped tip of the respective bristle is formed by an oblique cut like a simple wedge, so that a first side of the bristle concerned has a maximum longitudinal extent ($L_{MAX}$) and the second side diametrically opposite to it has a minimum longitudinal extent ($L_{MIN}$). A particularly long and, relative to the longitudinal bristle axis, gently sloping wedge surface can thus be produced, which benefits the effect to be utilized according to the invention.

For other cases of application, the wedge-shaped tip can be formed by a double oblique cut, which consists of two surfaces that run towards each other and intersect at the free end of the bristle, at least in their imaginary extension. In this manner, the bristle concerned is able to act on both sides and thus influence two eyelashes at the same time, which have come to lie against the bristle from different sides. A part of the bristles can have a wedge-shaped tip formed by a double oblique cut, which has two cut faces running towards each other which, or the imaginary extensions of which, intersect at or in the area of the free end of a respective bristle. A bristle configured in this manner is able to push eyelashes away to both sides and thus separate them. Unlike a bristle that is simply obliquely cut, such a bristle does not exhibit an irritating preferred direction.

It is particularly beneficial if the cut faces are substantially planar in themselves. Ideally, two opposite cut faces at the same bristle end substantially have the same size.

The bristles can be orientated in such a way that the one or the two opposite cut face(s) at a bristle tip are disposed transversely to the longitudinal wire core axis, wherein, then, particularly those bristles that are equipped only with a unilateral cut face are disposed and orientated in such a way that a part of the respective cut faces is orientated with an orientation towards the brush tip carrying the bristle covering, and a part is orientated towards the opposite brush end. In another embodiment, the invention is therefore characterized in that the cut faces are orientated transversely, in particular perpendicularly, to the longitudinal wire core axis (LD). Further, it is advantageous in this case if the cut faces of the bristles are, in part, orientated with one cut face in the direction towards the brush end and, in part, towards the brush tip. Accordingly, within the context of this preferred exemplary embodiment, it is provided that the cut face formed by the oblique cut is orientated in such a way that, looking along the longitudinal wire core axis (i.e. looking frontally at the free end of the wire core or frontally at the free end of the wire core provided for attachment to the stem), one looks frontally at the cut face, whereas one does not look at the cut face if one looks in the circumferential direction. Preferably, this applies to all bristles of the covering.

A mascara brush can have several types of bristles configured differently at their bristle tips. For example, a bristle covering can have, in its entirety, bristles with a tip that is not pointed and not formed in a wedge-shape, and bristles with a bristle tip that is formed in a wedge-shape and has two opposite cut faces, and bristles with a bristle tip that is formed in a wedge-shape but has a cut face only on one side, with the cut faces being orientated in different directions, in one case towards the bristle end and in one case towards the bristle tip. Therefore, it is particularly useful if individual types of bristles are systematically arranged in the bristle covering and are respectively associated with areas, zones or sectors of the bristle covering. In one development, the invention is therefore further characterized in that the bristle covering has several areas, sectors or zones, which are orientated to extend, in the circumferential direction of the bristle covering, transversely, in particular perpendicularly, to the longitudinal wire core axis (LD), or, in the circumferential direction of the bristle covering, spiral-shaped to the longitudinal wire core axis (LD), or, in the longitudinal direction of the bristle covering, alongside of, in particular parallel to, the longitudinal wire core axis (LD), and which respectively comprise at least one bristle row consisting of several adjacent bristles that each have an identically configured bristle tip, or are formed by such a bristle row, and which, in the circumferential direction and/or in the longitudinal direction of the bristle covering, are respectively disposed adjacent to one area or sector or zone which comprises several bristles and whose bristles have, in comparison therewith, a differently configured bristle tip.

In this case, however, it is also possible that the bristle covering has several areas, sectors or zones, which are orientated to extend, in the circumferential direction of the bristle covering, transversely, in particular perpendicularly, to the longitudinal wire core axis (LD), or, in the circumferential direction of the bristle covering, spiral-shaped to the longitudinal wire core axis (LD), or, in the longitudinal direction of the bristle covering, alongside of, in particular parallel to, the longitudinal wire core axis (LD), and which respectively comprise at least one bristle row which consists of several adjacent bristles and whose adjacent bristles each have a differently configured bristle tip.

Thus, for example, of the above-described types of bristles or of those described in this application as a whole, all bristle types can be disposed in each case individually alternately adjacent to each other in an area or a zone or a sector and thus form an area or a zone or a sector. However, it is also possible that only one bristle type is respectively disposed in an area or a zone or a sector and that then, for example in the circumferential direction of the bristle covering, an area or a zone or a sector with, respectively, at least one different bristle type respectively follows alternately. Preferably, an area or a zone or a sector comprises at least two bristles. Of course, all logically possible combinations of bristle types and areas, zones and sectors are possible. For example, not all of the above-mentioned bristle types or all of the bristle types described herein as a whole have to exist in every zone or every area or every sector or be present, as a matter of principle, in a bristle covering.

The extent of a zone, an area or a sector may vary. In another useful embodiment, the invention therefore provides that the several areas, sectors or zones, in the circumferential direction, transversely or longitudinally to the longitudinal wire core axis (LD), sweep over the circumference or a partial area of the circumference of the bristle covering once.

In principle, an area or a zone or a sector sweeps over an angular distance that constitutes ⅛ to 1/64 of the circumference or of the enveloping circle of the bristle covering, and thus an angular extent between 5.6° and 45°.

With respect to the bristles that are respectively equipped with a beveled cut face, it may be useful to provide, in each case alternately, an area or a sector or a zone in which the cut faces of all bristles are orientated to point in the direction towards the brush tip, and an area or a sector or a zone in which the cut faces of all bristles are orientated to point in the direction towards the brush end. For example, this can be produced by moving, in a first step, a grinding disk over the bristle covering from the brush tip, parallel and alongside the longitudinal wire core axis, to the brush end in order to produce the cut faces, then rotating the bristle covering or the mascara brush by ⅛ of a turn, for example, which corresponds to a rotation by 45°, and then moving the grinding disk in a second step in a direction opposite to the first step from the brush end, parallel and alongside the longitudinal wire core axis, to the brush tip. This sequence of steps is carried out until the grinding disk has moved and swept across the full 360° circumference of the bristle covering once.

Furthermore, it may be advantageous if the bristle covering consists of bristles or filaments with a wedge-shaped pointed portion and consists of further bristles or filaments without a wedge-shaped pointed portion, the bristle covering being preferably configured in such a way that the bristles or filaments with a wedge-shaped pointed portion form one or more sector(s) of the bristle covering and the further bristles or filaments form one or more further sector(s), the sector(s) and the further sector(s) preferably and ideally following each other alternately in the circumferential direction, which an embodiment of the invention also provides.

According to another embodiment of the invention, it is useful if between 1 and 8 sectors and between 1 and 8 further sectors are provided.

In this case, it may further be advantageous that the bristles or filaments with the wedge-shaped pointed portion are disposed in such a way, in the bristle covering that otherwise consists of further bristles or filaments, that they form a track extending in a spiral shape on the circumferential enveloping surface of the bristle covering, which the invention also provides.

Furthermore, it may be useful that the further bristles or filaments are made of the same material as the bristles or filaments with a wedge-shaped pointed portion.

Also in this case, it is advantageous that the chisel faces of the bristles or filaments with a wedge-shaped pointed portion, neglecting their wedge angle, are orientated perpendicularly to the course of the imaginary longitudinal axis of the spiral-shaped track.

It is particularly useful if the angle (a) by which the cut face(s) formed by the oblique cut or the double oblique cut is/are inclined relative to the longitudinal bristle axis complies with the relationship $\alpha \leq 55°$, and ideally even $\alpha \leq 35°$. This results in each case in a particularly long cut face well-suited for use, because it slopes only gently relative to the longitudinal bristle axis. Compliance with the relationship $\alpha \leq 20°$ has proved to be absolutely ideal. Preferably, this is associated with a so-called double grinding, i.e. one and the same cut face is ground for a first time and then, in a separate working step, a second time, whereby such a steep angle can be obtained. Therefore, it may be provided that, for the angle by which the cut face(s) formed by the oblique cut or the double oblique cut is/are inclined relative to the longitudinal bristle axis, the relationship is $\alpha \leq 55°$, preferably $\alpha \leq 35°$, in particular $\alpha \leq 20°$.

The filaments forming the bristles can have a non-round cross section, and preferably a polygonal or quadrilateral cross section.

Surprisingly, it was found to be particularly beneficial to configure at least a part of the bristles or filaments in a tube-shaped, internally hollow manner, preferably over the entire length (prior to twisting). This results in a particularly beneficial synergistic effect, particularly if the oblique cut is produced by grinding the bristles. If the bristle is internally hollow, it is capable of storing mascara mass with its cavity, which is discharged during application to the outside via the mouth of the cavity, which is located right in the center of the cut face. As a result, the eyelashes are already pre-coated as they slide along the cut face, which further improves the application of mascara as a whole. An essential point is in this case that the oblique cut, or the wedge surface produced thereby, causes the mouth of the internally hollow bristle to become significantly larger and thus creates a larger area in which mascara mass can be stored in such a way that it is immediately available for discharge upon application, and that mascara mass that is stored slightly deeper in the bristle interior can also be discharged more easily via the greater area of the mouth. In addition, the cut face of the bristles produced by the oblique cut forms a large contact area, which the individual eyelash can slide along for a fairly long time before it slips off the end face of the bristle and comes to lie between adjacent bristles. Meanwhile, the eyelash has ample opportunity for being wetted with mascara mass. The individual eyelash is capable of remaining only for a much shorter time on a small-surface end face extending substantially perpendicular to the longitudinal bristle axis of a hollow bristle, before it slips into the spaces between the bristles. The bristles or filaments that are configured to be tube-shaped and internally hollow can be configured to be continuously slit in the direction along their longitudinal axis. It is beneficial to configure the bristles to be continuously slit in the direction along their longitudinal axis. In this manner, the bristles or filaments become slightly more unstable, or their stability can be controlled better, so that during application, the bristles are deformed more strongly in such a way that mascara mass stored in their cavity is discharged via its mouth in the area of the oblique cut.

Preferably, the outer diameter of bristles 1 with a circular configuration is ≥115 μm, and even better ≥215 μm. In the predominant number of cases, the outer diameter of the bristles 1 with a circular configuration used in the invention is ≤320 μm.

Where the bristles are non-circular, it applies that the outer enveloping circle of bristles configured to have a non-circular cross section has an enveloping circle diameter which is ≥100 μm, and better still ≥200 μm. In the predominant number of cases, the outer enveloping circle of the bristles with a non-circular configuration used in the invention is ≤340 μm, and better still, ≤320 μm. The enveloping circle is to be understood to be the circle into which the respective cross section of the bristle can be plotted with the best fit.

Both the outer diameter of the bristles and the enveloping circle diameter are configured to be ≤340 μm, in particular ≤320 μm, because the bristles would otherwise become so coarse that their capacity for separating the eyelashes is limited too much.

Where the bristles are hollow, the wall thickness of the bristles 1 used, which is measured perpendicularly to the outer surface, can be between 15 μm and 100 μm. The wall thickness of the bristles, or of their bristle jacket which delimits the cavity inside the bristle, is in each case selected such that the hollow bristle, under the influence of the forces typically occurring during application, undergoes sufficiently strong deformation to press the mass stored in its interior towards the outside.

It has proved to be particularly beneficial if the corners of the radially outward bristle tips are rounded.

Alternatively, but not preferably, or additionally, an effect improving the mass accommodating capacity can also be obtained by so-called indentations, i.e. point-shaped depressions, or by particles protruding locally from the surface, i.e. by a plurality of local depressions in the bristle surface which, seen microscopically or greatly enlarged, provide the bristle surface with a profile like a crispbread and thus make it more absorbent, or by particles admixed to the plastic material. Advantageously, the number of indentations or point-shaped depressions or impressions distributed over a respective bristle is greater than 200.

Further advantages, mechanisms of action and optional embodiments of the invention become apparent from the following description of an exemplary embodiment with reference to the Figures.

DETAILED DESCRIPTION OF THE INVENTION

Figure 5:
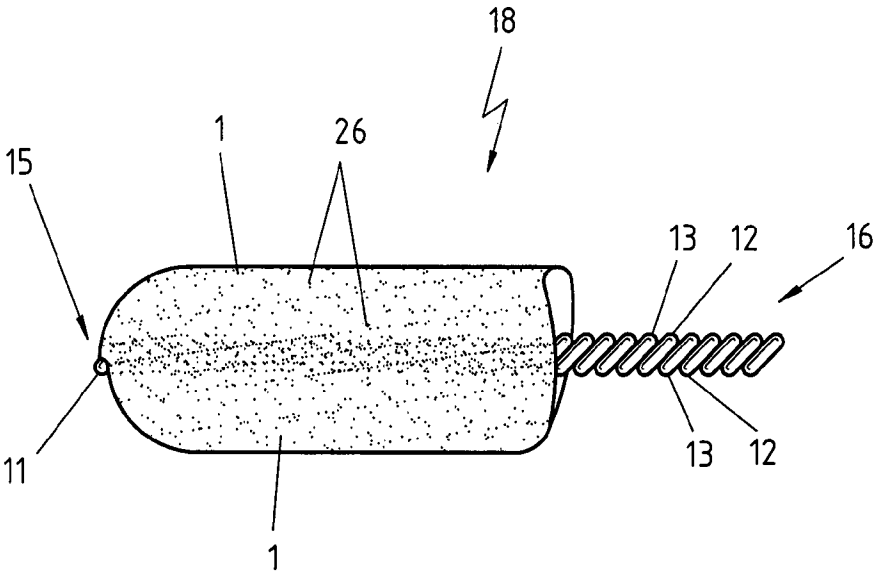
FIG. 5 is a complete overview of a wire core applicator equipped with the bristles according to the invention.

Generally, such an applicator as it is shown by FIG. 5 is produced by placing a plurality of, at first, mostly straight filaments between at least one wire clamp 11 with two straight wire portions 12, 13. Preferably, a portion of a continuously extruded fiber is referred to as a filament in the sense of the invention. Generally, the filaments are placed between the wire sections 12, 13 of the wire clamp 11 in such a way that they protrude to a substantially equal extent (preferably maximally +/−10%) on both sides of the wire clamp 11 or of its wire portions 12, 13.

The wire portions 12, 13 are then twisted together, whereby the filaments are distributed and then firmly clamped between the wire portions. Generally, each filament forms two bristles 1. Thus, it is only "different sides of the same coin" that are addressed within the context of this description when the term "filament" is used at one time and the term "bristle" at another time.

Figure 3:
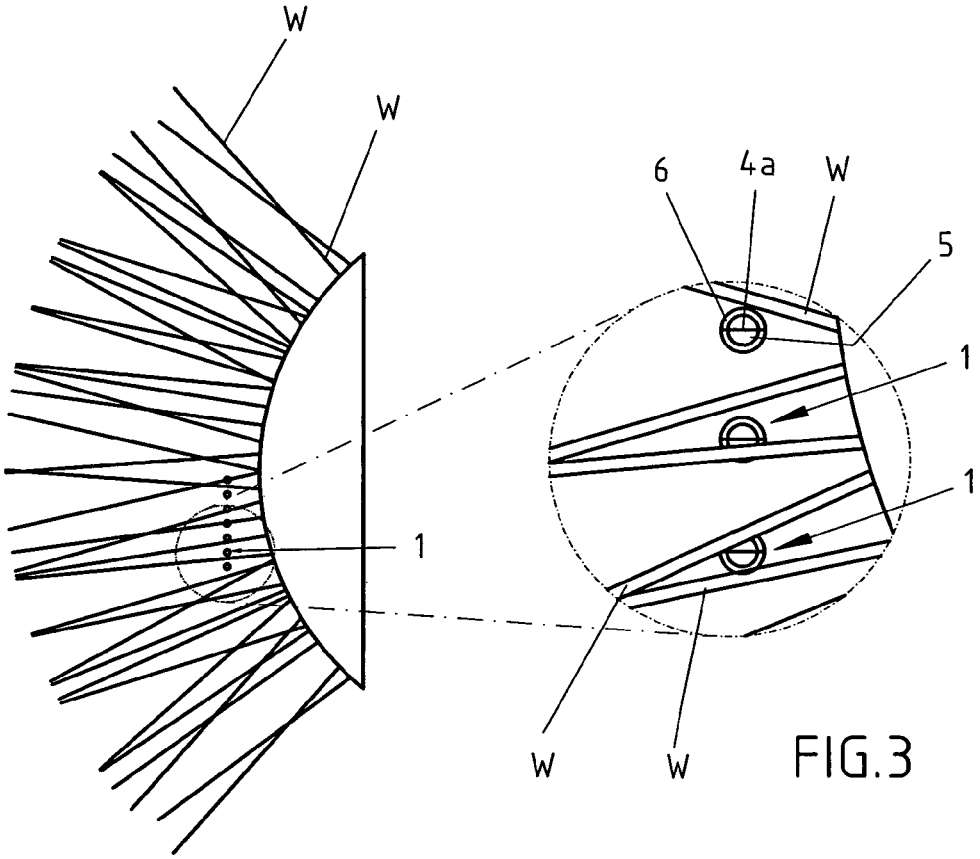
FIG. 3 shows an applicator equipped with the inventive bristles according to FIG. 1 when it is first put up against the curve of the eyelashes and enters it.

The problem underlying the invention can best be explained with reference to FIG. 3. FIG. 3 shows the typical condition of a curve of eyelashes. The individual eyelashes W are not naturally situated "one next to the other", but individual eyelashes W extend in an oblique manner and overlap with one or more adjacent eyelashes.

Figure 4:
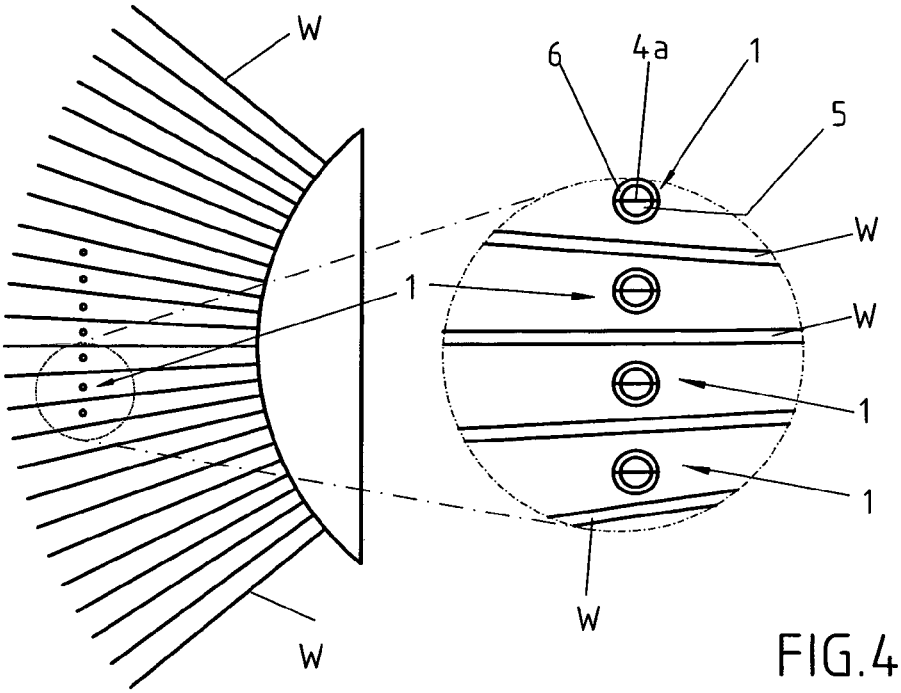
FIG. 4 shows the applicator equipped with the inventive bristles according to FIG. 1 after it has almost finished combing/separating the curve of the eyelashes.

In contrast, FIG. 4 shows the ideal state after the treatment of the curve of eyelashes with a mascara applicator. The eyelashes W are combed and ideally orientated so as to lie next to one another almost parallel and extend slightly star-shaped, so that the free end of adjacent eyelashes W are slightly more distant from each other than the root areas of these eyelashes.

In order to act upon the eyelashes shown by FIG. 3 with an applicator, one brings the applicator with its bristles 1 that are to be directly engaged with the eyelashes W up close to the eyelid, and then attempts to push the bristles 1 into the interspaces between adjacent eyelashes W. In this case, the longitudinal bristle axes L and the longitudinal axes of the eyelashes in this situation are approximately perpendicular to each other, as is shown in FIG. 3.

Relatively thick bristles are rigid and do not buckle immediately if they come up against eyelashes and thus, resistance. However, it is found that an approximately straight bristle end face extending approximately perpendicularly to the longitudinal bristle axis L, as it is produced by simply "cutting off" a filament from a continuous thread, is disadvantageous—the more so, the thicker the bristle diameter is, i.e. the more rigid the bristle has been designed to be.

The reason for this is relatively easily understood by referring to FIG. 3:

During the attempt to push the bristle concerned between the eyelashes, the end face possibly impacts one or more eyelashes at an obtuse angle. In that case, the eyelashes are first lifted up instead of pushed to the side. Possibly, the separation result suffers as a consequence of this, because it is by no means certain that such an eyelash, which has first been lifted up, at the end snaps back to the side of the bristle on which it was actually to come to rest to achieve an optimum separation result.

In this case, the bristles according to the invention are clearly at an advantage.

Figure 1:
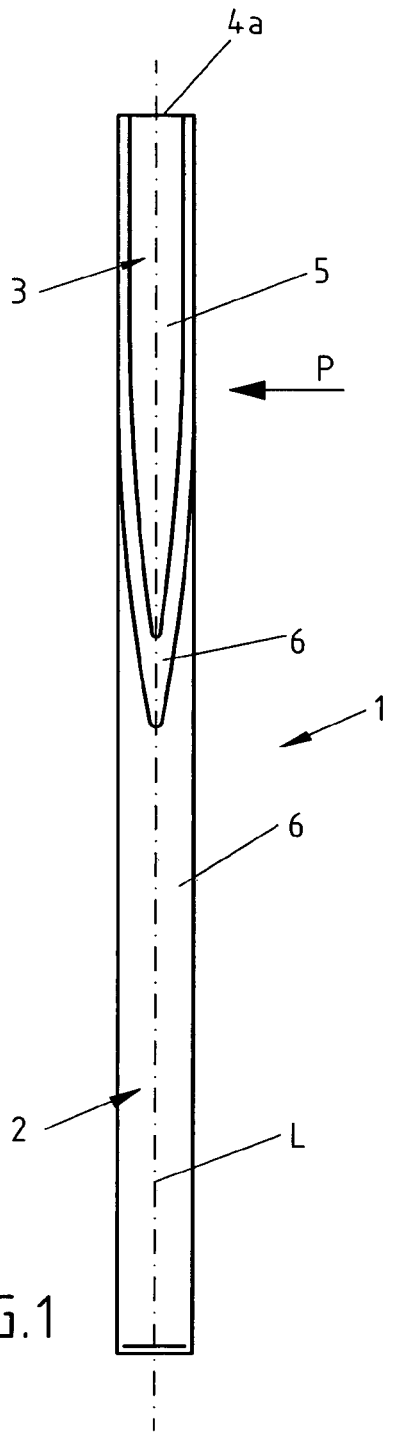
FIG. 1 shows a bristle according to the invention in a side view of its chisel face.
Figure 2:
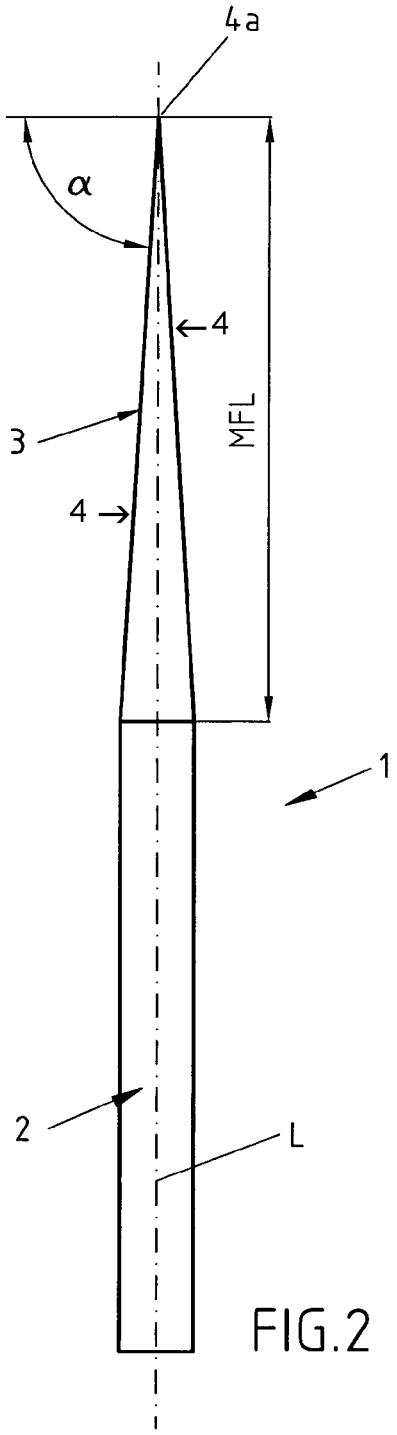
FIG. 2 shows the bristle according to FIG. 1, but in the direction of viewing marked in FIG. 1 by the arrow P.
Figure 2A:
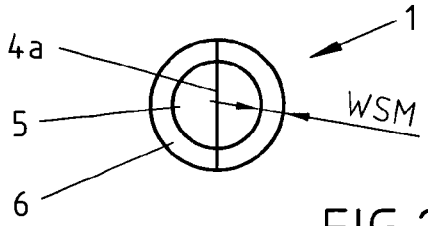
FIG. 2*a* shows an enlarged frontal view of the bristle according to FIG. 2.

FIGS. 1 and 2 show an exemplary embodiment of such bristles 1 according to the invention. As can best be seen with reference to FIG. 1, each of the bristles 1 according to the invention can be divided into two portions, i.e. the bristle shaft 2 and a wedge-shaped pointed portion 3. In the simplest case, the wedge-shaped pointed portion 3 can be formed by a single oblique cut through the bristle, and then looks like the obliquely cut end of a cut rose—a solution that is not shown here in the Figures.

Ideally, the wedge-shaped pointed portion is formed by 2 chisel faces 4 that extend obliquely relative to one another and most frequently intersect at the free end of the bristle, or in any case come closest to each other there. Most frequently, the two chisel surfaces are in this case of equal size. In the area of the wedge-shaped pointed portion 3, this results in the shape shown by FIG. 2, which, so to speak, is roof-shaped.

The structure of a bristle according to the invention consisting of a bristle core 5 made from a harder material or plastic and a bristle jacket 6 made from a softer material or plastic is easily recognizable at the chisel faces in whose area the bristle core is obliquely cut over a long distance, see FIG. 1.

As can be seen, the bristle core 5 forms a free outer edge in the form of the chisel cutting edge 4*a* only along the ridge line of the free bristle end. On all other sides, the bristle core 5 nestles up everywhere against the bristle jacket 6 and is stabilized by it, despite the wedge-shaped pointed portion 3. It is also easily recognizable that the bristle core 5 is preserved for the predominant part and therefore retains its supporting function, despite the considerable material removal in the area of the wedge-shaped pointed portion 3. Thus, an even more strongly wedge-shaped pointed portion can be obtained with the usual methods, which in turn improves the separation effect.

Preferably, the bristles 1 according to the invention are configured in such a way that the chisel faces 4 are inclined to the horizontal at an angle $\alpha \geq 800$. Not only because of this, this results in very pronounced chisel faces 4, which preferably have such a length that they extend over at least ¼, better yet over at least ⅓ of the total length of a bristle—in the manner seen in FIG. 2, referring to the chisel face length MFL dimensioned therein, where the chisel faces 4 extend over more than 40% of the total length of the bristle.

The filaments used within the context of the invention are preferably filaments from at least one continuously co-extruded thread. To produce such threads, two nozzles supplied with different plastic materials are disposed coaxially so that a continuous cylinder (the subsequent bristle core) and an, at first most frequently slit, tube (the subsequent bristle jacket) surrounding it are extruded synchronously, which are then glued or welded together. The extrusion results in a significant stretching/alignment of the plastic molecule chains, which is the reason why the thread produced in this way and therefore also the filaments cut from it have excellent application properties, above all an excellent bend recovery capacity.

It must be noted that FIGS. 1 and 2 show an exemplary embodiment whose chisel faces 4 are substantially planar, i.e. level in itself, and most frequently also of the same size.

Alternatively, the chisel faces are in some cases progressively concavely curved in the direction along the longitudinal axis L, so that the result is an area that is longer in the axial direction and in which the tip is slender.

Figure 8:
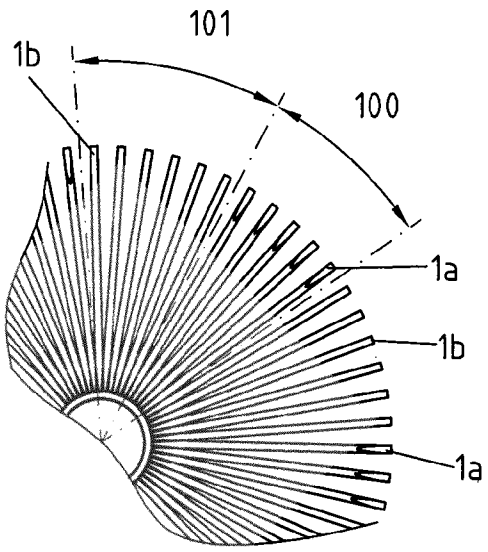
FIG. 8 shows a section of the variant shown by FIG. 6, in a frontal view from the front.
Figure 7:
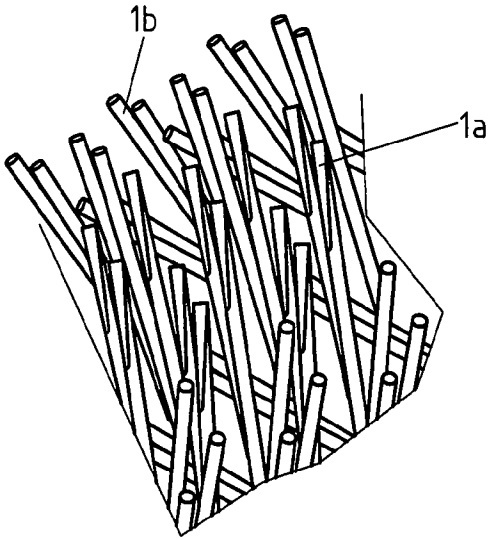
FIG. 7 shows an enlarged detail from FIG. 6.
Figure 6:
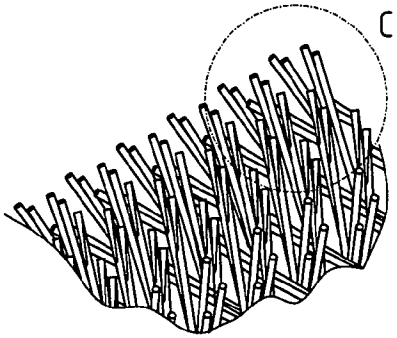
FIG. 6 shows a variant of the invention with alternately pointed and non-pointed bristles.

FIGS. 6, 7 and 8 illustrate a variant of the mascara brush 18 according to the invention, with an exceptionally advantageous application and separation action.

As can be seen, the bristle covering in this case consists of bristles 1*a* with a wedge-shaped pointed portion that are formed by filaments, and of bristles 1*b* without a wedge-shaped pointed portion that are also formed from filaments.

In this case, the bristle covering is configured in such a way that the bristles 1*a* with a wedge-shaped pointed portion form a sector 100 of the bristle covering 26 and the further bristles 1*b* form another sector 101. In the example illustrated by the Figures, the sectors 100 and the further sectors 101 follow each other alternately in the circumferential direction.

The number of the sectors 100, 101 depends on the individual case of use and the rheological properties of the cosmetic used. Preferably, between 1 and 8 sectors and between 1 and 8 further sectors are provided.

Alternatively, there is the option of the filaments with the wedge-shaped pointed portion being disposed in such a way, in the bristle covering that otherwise consists of further filaments, that they form a track extending in a spiral shape on the circumferential enveloping surface of the bristle covering, which is not shown here in the Figures.

Ideally, the further filaments are made of the same material as the filaments with a wedge-shaped pointed portion.

In another variant of the mascara applicator previously explained with reference to the Figures, which is also inventive and therefore claimed, the covering is configured in such a way that the chisel faces of the filaments with a wedge-shaped pointed portion, neglecting their wedge angle, are orientated perpendicularly to the course of the imaginary longitudinal axis of the spiral-shaped track.

Figure 9:
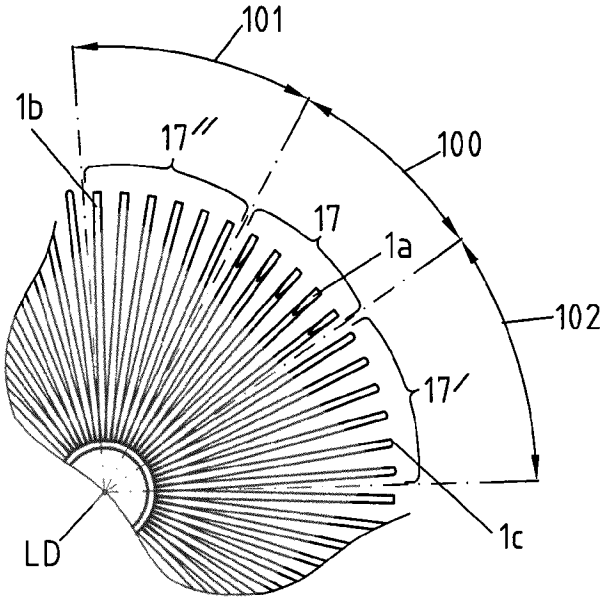
FIG. 9 shows a section of an alternative embodiment of the bristle variant shown in FIGS. 6 and 7.

FIG. 9 illustrates a variant of the mascara brush according to the invention, with an exceptionally advantageous application and separation action.

As can be seen, the bristle covering 26 in this case consists of bristles 1*a*, 1*c* with a wedge-shaped pointed portion that are formed by filaments, and of further bristles 1*b* without a wedge-shaped pointed portion that are also formed from filaments, with the bristles 1*a*, 1*c* only differing with regard to the orientation of their cut face 4. The cut face 4 of each of the bristles 1*a* points towards the brush end 16, and the cut face 4 of each of the bristles 1*c* points towards the brush tip 15.

In this case, the bristle covering 26 is configured in such a way that the bristles 1*a* with the wedge-shaped pointed portion, of which several are disposed adjacent to each other in a bristle row 17, form a sector 100 of the bristle covering 26, the bristles 1*c* with the wedge-shaped pointed portion, of which several are disposed adjacent to each other in a bristle row 17', form a sector 102 of the bristle covering 26, and the further bristles 1*b*, disposed in a bristle row 17", form a further sector 101 of the bristle covering 26. In the example illustrated in FIG. 9, the sectors 100 and 102 and the further sector 101 follow each other alternately in the circumferential direction. The sector 102 is followed again by a sector 101. The sequence of sectors is continued until an arc of a circle of 360° is completed over the circumference of the bristle covering 26.

The number of the sectors depends on the individual case of use and the rheological properties of the cosmetic used. Preferably, between 1 and 8 sectors 100, 102 and between 1 and 8 further sectors 101 are provided.

Alternatively, there is the option of the filaments or bristles 1*a*, 1*c* with the wedge-shaped pointed portion being disposed in such a way, in the bristle covering 26 that otherwise consists of further filaments or bristles 1, 1*b*, that they form a track extending in a spiral shape on the circumferential enveloping surface of the bristle covering 26, which is not shown here in the Figures.

Ideally, the further filaments or bristles 1*b* are made of the same material as the filaments or bristles 1*a*, 1*c* with a wedge-shaped pointed portion.

In another variant of the mascara applicator previously explained with reference to the Figures, which is also inventive and therefore claimed, the covering is configured in such a way that the chisel faces of the filaments or bristles with a wedge-shaped pointed portion, neglecting their wedge angle, are orientated perpendicularly to the course of the imaginary longitudinal axis of the spiral-shaped track.

While all the bristles 1*a*, 1*b*, 1*c* of a respective bristle row 17, 17, 17" are identically configured with regard to the configuration of the bristle tip in the exemplary embodiment according to FIG. 9, a bristle row may of course also be formed of bristles that each have differently configured bristle tips. For example, it is possible that bristles 1*a*, 1*b*, 1*c* are formed next to one another and adjacently in a bristle row, which are disposed in a repeating pattern relative to each other, with the pattern forming a sector, an area or a zone. All logically possible combinations can be realized. Also, sectors, areas or zones may extend in a spiral shape over the circumference of the bristle covering 26 or be disposed, configured and orientated so as to extend in the longitudinal direction of the longitudinal wire core axis LD.

What is claimed is:

1. A mascara brush, comprising:

an inner core of at least two wire portions twisted together; and a bristle covering of bristles formed by filaments that are each held clamped between the at least two wire portions, the bristles having a wedge-shaped pointed portion at their free ends, wherein the wedge-shaped pointed portion is formed by two chisel faces that are concavely curved, and the bristles having a bristle jacket formed of a first, softer material and a bristle core, which is connected to the bristle jacket, formed of a second, harder material.

2. The mascara brush according to claim 1, wherein the first material and the second material are each a thermoplastic plastic.

3. The mascara brush according to claim 1, wherein the two materials are firmly bonded to each other by co-extrusion of a continuous thread, and the filaments are sections of one or more of such continuous threads.

4. The mascara brush according to claim 1, wherein the wedge-shaped pointed portion consists of two chisel faces or cut faces that extend obliquely to a longitudinal bristle axis (L), and are inclined relative to one another and intersect at a distal end of the filament.

5. The mascara brush according to claim 4, wherein the chisel faces or cut faces are substantially planar in themselves and two chisel faces or cut faces that are opposite to each other at the same bristle end are substantially of the same size.

6. The mascara brush according to claim 4, wherein a surface roughness of the chisel faces or cut faces is greater than a surface roughness of a non-beveled shaft region of the bristle or filament.

7. The mascara brush according to claim 1, wherein the wedge-shaped pointed portion or a cut face has a surface roughness (Rz) of between 0.2 μm and 6.3 μm.

8. The mascara brush according to claim 1, wherein the second material has an E modulus of ≥1300 N/mm$^2$, the E modulus not exceeding 2700 N/mm$^2$.

9. The mascara brush according to claim 1, wherein the first material has a Shore D hardness of ≤80.

10. The mascara brush according to claim 1, wherein a diameter of the filaments is ≥115 μm.

11. The mascara brush according to claim 1, wherein a wall thickness of the bristle jacket measured in a radial direction is between 15 μm and 100 μm.

12. The mascara brush according to claim 1, wherein at least a part of the bristles is produced by co-extrusion from a first plastic material and a second plastic material different from the first plastic material, wherein the two plastic materials differ with regard to a modulus of elasticity and/or a Shore D hardness, and wherein the first plastic material has a Shore D hardness≤80 and/or the second plastic material has a modulus of elasticity of at least 1300 N/mm$^2$, and after a grinding process of the areas respectively consisting of one of the first and second plastic materials, namely the bristle core and the bristle jacket, with one and the same grinding disk, which is carried out for producing the respective cut face, different roughnesses are produced in an area of the bristle core and in an area of the bristle jacket that respectively have a surface roughness (Rz) between 0.2 μm and 6.3 μm.

13. A mascara brush, comprising:

an inner core of at least two wire portions twisted together along a longitudinal wire core axis (LD); and a bristle covering of bristles of plastic formed by filaments that are each held clamped between the at least two wire portions and that are configured at their free ends with a wedge-shaped or without a wedge-shaped bristle tip, wherein at least a part of the bristles has a bristle jacket formed of a first, softer material and a bristle core, which is connected to the bristle jacket, formed of a second, harder material, and these bristles, at least partially, have at their radially outward free ends a unilateral or bilateral oblique cut like a simple wedge, and comprise a wedge-shaped bristle tip with at least one cut face forming a wedge in the form of a chisel face that is concavely curved.

14. A mascara brush, comprising:

an inner core of at least two wire portions twisted together; and a bristle covering of bristles formed by filaments that are each held clamped between the at least two wire portions, the bristles having a wedge-shaped pointed portion at their free ends, and the bristles having a bristle jacket formed of a first, softer material and a bristle core, which is connected to the bristle jacket, formed of a second, harder material, wherein the bristle covering consists of bristles or filaments with a wedge-shaped pointed portion and of further bristles or filaments without a wedge-shaped pointed portion, and the bristles or filaments with a wedge-shaped pointed portion form a plurality of sectors of the bristle covering and the further filaments form a plurality of further sectors, the sectors and the further sectors following each other alternately in a circumferential direction.

15. The mascara brush according to claim 14, wherein the bristles or filaments with the wedge-shaped pointed portion are disposed in such a way, in the bristle covering that otherwise consists of further bristles or filaments, that the bristles or filaments with the wedge-shaped pointed portion form a track extending in a spiral shape on a circumferential enveloping surface of the bristle covering.

16. The mascara brush according to claim 15, wherein chisel faces of the bristles or filaments with a wedge-shaped pointed portion, neglecting their wedge angle, are orientated perpendicularly to an imaginary longitudinal axis of the spiral-shaped track.

17. The mascara brush according to claim 14, wherein the further bristles or filaments are made of the same material as the bristles or filaments with a wedge-shaped pointed portion.

18. A mascara brush, comprising:

an inner core of at least two wire portions twisted together along a longitudinal wire core axis (LD); and a bristle covering of bristles of plastic formed by filaments that are each held clamped between the at least two wire portions and that are configured at their free ends with a wedge-shaped or without a wedge-shaped bristle tip, wherein at least a part of the bristles has a bristle jacket formed of a first, softer material and a bristle core, which is connected to the bristle jacket, formed of a second, harder material, and these bristles, at least partially, have at their radially outward free ends a unilateral or bilateral oblique cut like a simple wedge, and comprise a wedge-shaped bristle tip with at least one cut face forming a wedge, wherein the bristle covering has a plurality of areas, sectors or zones, which are orientated to extend, in a circumferential direction of the bristle covering, transversely to the longitudinal wire core axis (LD), or, in the circumferential direction of the bristle covering, spiral-shaped to the longitudinal wire core axis (LD), or, in a longitudinal direction of the bristle covering, alongside of the longitudinal wire core axis (LD), and which respectively comprise at least one bristle row consisting of a plurality of adjacent bristles that each have an identically configured bristle tip, or are formed by such a bristle row, and which, in the circumferential direction and/or in the longitudinal direction of the bristle covering, are respectively disposed adjacent to one area or sector or zone which comprises a plurality of bristles each having a differently configured bristle tip.

19. A mascara brush, comprising:

an inner core of at least two wire portions twisted together along a longitudinal wire core axis (LD); and a bristle covering of bristles of plastic formed by filaments that are each held clamped between the at least two wire portions and that are configured at their free ends with a wedge-shaped or without a wedge-shaped bristle tip, wherein at least a part of the bristles has a bristle jacket formed of a first, softer material and a bristle core, which is connected to the bristle jacket, formed of a second, harder material, and these bristles, at least partially, have at their radially outward free ends a unilateral or bilateral oblique cut like a simple wedge, and comprise a wedge-shaped bristle tip with at least one cut face forming a wedge, wherein the bristle covering has a plurality of areas, sectors or zones, which are orientated to extend, in a circumferential direction of the bristle covering, transversely to the longitudinal wire core axis (LD), or, in the circumferential direction of the bristle covering, spiral-shaped to the longitudinal wire core axis (LD), or, in a longitudinal direction of the bristle covering, alongside of the longitudinal wire core axis (LD), and which respectively comprise at least one bristle row which consists of a plurality of adjacent bristles and whose adjacent bristles each have a differently configured bristle tip.

20. The mascara brush according to claim 19, wherein the plurality of areas, sectors or zones, in the circumferential direction, transversely or longitudinally to the longitudinal wire core axis (LD), sweep over a circumference or a partial area of the circumference of the bristle covering once.

* * * * *